United States Patent [19]

Ohman

[11] Patent Number: 4,584,737

[45] Date of Patent: Apr. 29, 1986

[54] DRAPERY SUPPORT WITH SNAP-IN PENDANT AND PENDANT RETAINER CLIP

[75] Inventor: Thor Ohman, Madison, Wis.

[73] Assignee: Graber Industries, Inc., Middleton, Wis.

[21] Appl. No.: 661,374

[22] Filed: Oct. 16, 1984

[51] Int. Cl.[4] ..... E05D 15/06

[52] U.S. Cl. ..... 16/87.4 R; 16/93 D; 16/102; 403/155

[58] Field of Search ..... 16/87.4 R, 93 R, 93 D, 16/95 R, 95 D, 95 W, 95 DW, 97, 98, 102; 403/155

[56] References Cited

U.S. PATENT DOCUMENTS

| | | | |
|---|---|---|---|
| 3,479,682 | 11/1969 | McNinch | 16/97 |
| 3,951,197 | 4/1976 | Cohen et al. . | |
| 3,984,191 | 10/1976 | Doty | 403/155 X |
| 4,227,282 | 10/1980 | Ford et al. . | |

FOREIGN PATENT DOCUMENTS

| | | | |
|---|---|---|---|
| 2811330 | 5/1978 | Fed. Rep. of Germany | 403/155 |

*Primary Examiner*—Fred Silverberg

*Attorney, Agent, or Firm*—Vernon J. Pillote

[57] ABSTRACT

A drapery panel support system of the type including a rod defining a track, carriers mounted for movement along the track, and pendants mounted on the carriers for swivelling movement about an upright axis. The carriers each have a pendant support portion below the track with a laterally notch opening at one side edge of the pendant support portion and arranged to receive a neck portion on a pendant with a snap fit. A pendant retainer clip is shaped to underlie the carrier and has flanges which engage opposite side edges of the pendant support portion in the carrier and a notch in one end arranged to receive the neck portion on the pendant when the clip is in a pendant retaining position on the carrier.

12 Claims, 6 Drawing Figures

DRAPERY SUPPORT WITH SNAP-IN PENDANT AND PENDANT RETAINER CLIP

BACKGROUND OF THE INVENTION

Drapery panel support systems have heretofore been made such as disclosed in U.S. Pat. Nos. 3,951,197 and 4,227,282, in which drapery carriers are mounted for movement along a track and have pendants detachably and swivelly mounted in a laterally opening notch on the carriers below the track. The laterally opening notches in the carriers are arranged so that the pendants can be snapped into the notches in the carriers to facilitate assembly of the pendants and the draperies attached thereto onto the carriers, and to also enable the pendants to be snapped out of the notches for disassembly of the pendants from the carriers. Some problems have been encountered with unintentional detachment of the pendants from the carrier during use of the drapery panel support system, such as can occur when a lateral pull is exerted on the draperies attached to the pendant, during opening or closing of the draperies.

SUMMARY OF THE INVENTION

It is an object of the present invention to overcome the disadvantages of the prior art by providing a drapery panel support system of the type having carriers movable along a track and pendants detachably and swivelly mounted on the carriers, with pendant retaining clips which prevent unintentional detachment of the pendants from the carrier, and which yet allow swivelling of the pendants relative to the carriers and ready detachment and installation of the carrier when it is so desired.

Accordingly, the present invention provides a panel support system including an elongated rod defining a track and carrier means mounted on the track for movement therealong and having a lower pendant support portion disposed below the track, a panel support pendant detachably and swivelly mounted on the pendant support portion, and a detachable pendant retainer clip for holding the pendant on the carrier. The pendant support portion has an underface and spaced side edges generally paralleling the path of movement of the carrier along the track, and the pendant support portion has a laterally opening slot opening at one of said side edges and an upwardly facing pendant support shoulder at the inner end of the slot. The panel support pendant has a neck portion receivable in the slot and a head portion on the upper end of the neck portion engageable with the upwardly facing pendant support shoulder and supporting the pendant for swivelling movement relative to the pendant support portion of the carrier. The pendant retainer clip comprises a thin flat body having upwardly extending flanges along opposite side edges arranged to engage the opposite side edges of the pendant support portion when the clip is moved into a pendant retaining position underlying the underface of the pendant support portion. The body of the clip has a notch in one end arranged to receive the neck portion of the pendant when the clip is moved into its pendant retaining position, and means are provided for detachably holding the clip in its pendant retaining position.

With the above arrangement, the clip closes the open end of the slot in the pendant support portion of the carrier when the clip is in its retaining position. However, the clip is detachable to allow the pendant to be installed and removed from the carrier when desired.

The notch in the retaining clip is advantageously formed with a constricted portion arranged to snap past the neck on the carrier when the clip is moved into its retaining position to releasably hold the clip in its pendant retaining position. The pendant is advantageously formed with a shoulder spaced below the head on the pendant and arranged to underlie and support the clip when it is in its pendant retaining position.

BRIEF DESCRIPTION OF THE DRAWINGS

The invention is illustrated by way of example in the accompanying drawings which form a part of this application and in which.

DESCRIPTION OF PREFERRED EMBODIMENTS

Figure 1:
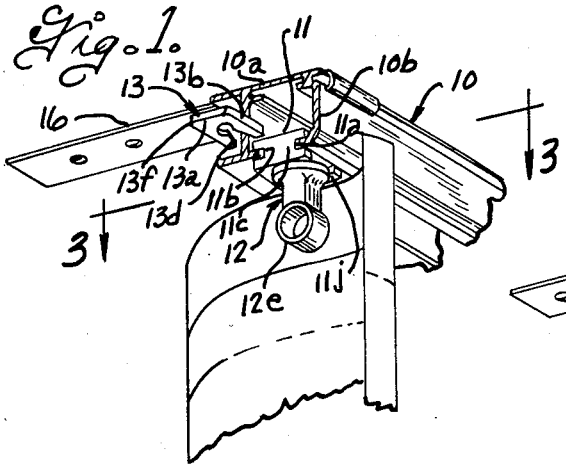
FIG. 1 is a fragmentary perspective view of a drapery panel support system and illustrating installation of the pendant retainer clip.
Figure 2:
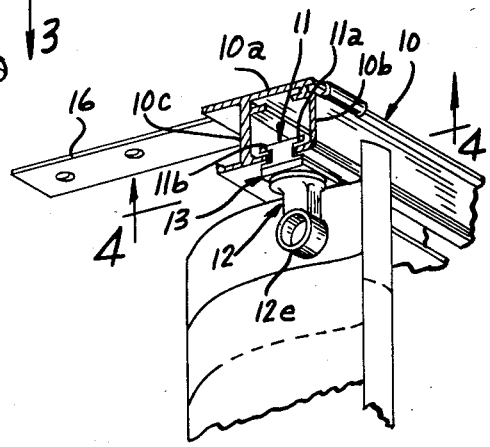
FIG. 2 is a perspective view of a drapery panel support system with the pendant retainer clip installed.

The drapery panel support system in general includes a rod 10 defining a trackway, a plurality of drapery carriers 11 mounted for movement along the trackway, a drapery support pendant 12 detachably and swivelly mounted on each of the carriers, and a detachable pendant retainer clip 13 for holding the pendants on the carrier to prevent unintentional detachment of the pendants from the carriers. The rod 10 is in the form of a downwardly opening channel having a top wall 10*a*, depending side walls 10*b* and 10*c*, and inwardly directed flanges 10*d* and 10*e* which are spaced apart and define a slot therebetween. The rod can be supported by any suitable means and, as shown, a mounting bracket 16 is provided to secure the rod to either a wall or an overhead such as a ceiling.

The inwardly directed flanges 10*d* and 10*e* form a track for the carriers 11 and the carriers are mounted for movement along the track. In the embodiment of FIGS. 1–5, the carriers comprise a generally rectangular body having grooves 11*a* and 11*b* at opposite sides which receive the flanges 10*d* and 10*e* to slidably and non-rotatably support the carriers for movement along the rod. The carriers are conveniently formed of a synthetic resin material and the carriers are formed with a pendant support portion 11*c* that is spaced below the track. The pendant support portion has a flat generally horizontal underface and spaced side edges 11*e* and 11*f* that generally parallel the path of movement of the carrier along the track, and end edges 11*h* that extend transverse to the side edges. The pendant support portion has a slot extending transverse to the direction of movement of the carrier along the track and opening at one of the side edges 11*e* intermediate its ends and an upwardly facing surface 11*k* that is spaced from the underside of the carrier body and which define an upwardly facing pendant support shoulder at the inner end of the slot.

Figure 3:
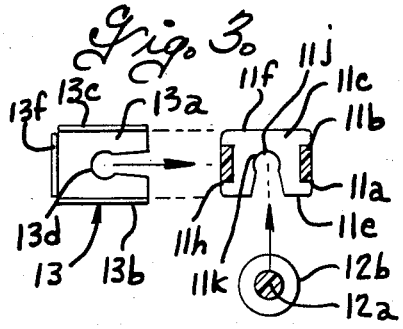
FIG. 3 is a fragmentary horizontal sectional view taken on the plane 3—3 of FIG. 1 and illustrating assembly of the pendant on the carrier and assembly of the retaining clip on the pendant and carrier.
Figure 4:
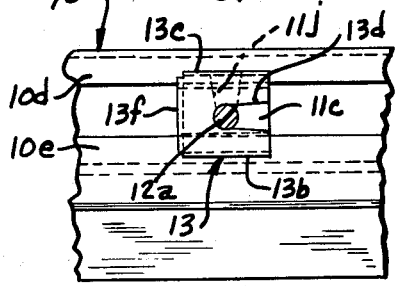
FIG. 4 is a fragmentary horizontal sectional view taken on the plane 4—4 of FIG. 2 and illustrating the pendant and clip assembled on the carrier.

The panel support pendant 12 has a neck portion 12*a* that is receivable in the slot 11*j* and a head portion 12*b* that is engageble with the upwardly facing pendant support shoulder and which supports the pendant for swivelling movement about an upright axis relative to the carrier. As best shown in FIG. 3, the slot 11*j* has a constriction spaced from its inner end and arranged to snap past the neck portion 12*a* on the pendant when the pendant is pressed into the slot, to releasably hold the pendant in the slot while allowing swivelling of the pendant relative to the carrier. Any suitable means may be provided for attaching the drapery panel to the carriers and, as shown, the pendants have a depending portion terminating in an eye 12*e* that may receive either a drapery hook or a snap fitting attached to the drapery, for example as disclosed in the aforementioned U.S. Pat. No. 3,951,197.

The pendant retaining clips 13 are provided for holding the pendants on the drapery carriers to prevent unintended detachment of the pendant from the carriers, while yet allowing swivelling of the pendants. The pendant retaining clip is detachable to enable removal and reinstallation of the drapery pendants, when it is desired to do so. The retaining clips comprise a thin flat metal body 13*a* shaped to underlie the underface of the pendant support portion and upwardly extending flanges 13*b* and 13*c* along opposite side edges arranged to extend alongside the side edges 11*e* and 11*f*, respectively on the pendant retaining portion of the carrier, when the clip is moved to a clip retaining position underlying the undersurface of the pendant support portion of the carrier. The clip also has a notch 13*d* in the body portion 13*a* that opens at one end of the clip, and which notch is arranged to receive the neck portion 12*a* of the pendant when the clip is in its pendant retaining position. A flange 13*f* is advantageously provided on the end of the clip opposite the end having the notch 13*d* and is arranged to engage one end of the pendant support portion on the carrier, when the clip is in its pendant retaining position.

Means are provided for detachably holding the clip in its pendant retaining position. In the preferred embodiment shown, the pendants 12 are formed with an upwardly facing shoulder 12*f* that is spaced below the head 12*b* and which is arranged to underlie and support the clip, when it is in its pendant retaining position. In addition, the notch 13*d* in the clip is formed with a constricted portion spaced from its inner end and arranged to snap past the neck 12*a* on the pendant when the clip is moved to its pendant retaining position, to detachably hold the clip against withdrawal from its pendant retaining position.

Figure 6:
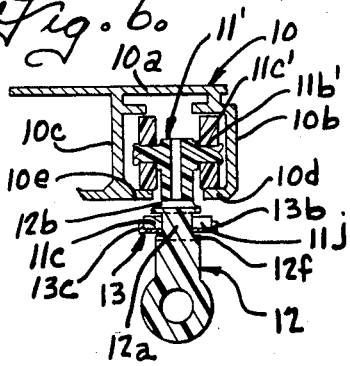
FIG. 6 is a transverse sectional view through a rod and drapery carrier illustrating a modified form of a drapery carrier.
Figure 5:
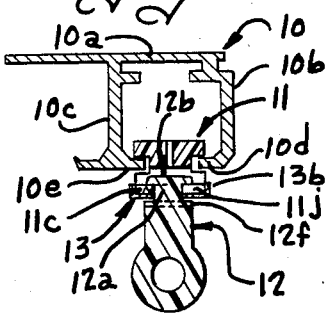
FIG. 5 is a transverse sectional view of through the rod, drapery carrier, pendant and clip.

A modified form of carrier is illustrated in FIG. 6. In this embodiment, like numerals are used to designate those parts which correspond to the embodiment of FIGS. 1–5 and numerals followed by the postscript ′ are used to designated modified parts. In the carrier 11′, the pendant support portion is the same as that previously described in connection with FIGS. 1–5, and the same numerals are used to designate like parts. This embodiment differs from that shown in FIGS. 1–5 in that the carrier 11′ is provided with laterally extending trunnions 11*b*′ and wheels 11*c*′ that are mounted on the trunnions and which are arranged to engage the flanges 10*d* and 10*e* to support the carrier for movement along the rod.

From the foregoing it is thought that the construction and use of the drapery support system will be readily understood. The carriers 11 and 11′ are mounted in the trackway for movement therealong and the drapery support pendants 12 are detachably and swivelly mounted on the pendant support portion of the carriers by snapping the neck 12*a* on each pendant into the laterally opening slot 11*j* in the carrier support portion. It is sometimes desired to remove the pendants from the carriers, for example when removing the draperies from the rod, and the slots are arranged so that the pendant can be snapped out of the slots in the pendant support portions. In order to prevent unintentional detachment of the pendants from the carriers during use of the panel support system, the pendant retaining clips 13 are provided and are movable from a position as shown in FIGS. 1 and 3, along a path paralleling the lengthwise direction of the rod, with the body 13*a* and flanges 13*b* and 13*c* respectively aligned with the underface and side edges 11*e* and 11*f* of the pendant support portion, into a pendant retaining position as shown in FIGS. ' and 4–6. When the clip is in its pendant retaining position, the body 13*a* of the clip closes the open side of the slot 11*j* in the pendant support portion of the carrier and the flanges 13*b* and 13*c* engage opposite side edges 11*e* and 11*f* of the pendant support portion to prevent movement of the clip in a direction laterally of the rod. This retains the pendant in the slot 11*j* in a positive manner. The clip is supported on the shoulder 12*f* on the pendants in close underlying relation with the underface of the pendant support portion of the carrier and the constricted portion in the slot 13*d* in the clip snaps over the neck 12*a* in the pendant when the clip is moved to its pendant retaining position, to releasably hold the clip against withdrawal. Since the pendant retaining clip can only be withdrawn by movement in a direction which is transverse to the direction that the pendant would have to move in order to move out of the slot 11*j*, the clip firmly holds the pendant against unintentional withdrawal from the carrier. However, the clip remains detachable from the pendant and carrier so that the pendant can be removed when desired. The flange 13*f* on the end of the clip functions as a stop to aid in positioning the clip on the pendant support portion of the carrier and also as a pressure applying surface to facilitate pressing the clip onto the neck portion of the pendant. A tool such as a blade of the screwdriver can be inserted behind the flange 11*f* when it is desired to withdraw the clip.

As is apparent, the panel support system can be used in rods having traverse cords for moving the carriers along the rods as well as in so-called manual traverse in which the carriers are moved along the rods by pulling on the drapery panels attached to the pendants.

The embodiments of the invention in which an exclusive property or privilege is claimed is:

1. A panel support system comprising, an elongated rod defining a track, carrier means mounted on the track for movement therealong and having a lower pendant support portion disposed below the track, a panel support pendant detachably and swivelly mounted on the pendant support portion, and a detachable pendant retainer clip for holding the pendant on the carrier, the pendant support portion having an underface and spaced side edges generally paralleling the path of movement of the carrier means along the track, the pendant support portion having slot means extending transverse to the direction of movement of the carrier means along the track and opening at one of said side edges intermediate its ends and an upwardly facing pendant support shoulder at the inner end of said slot means, the panel support pendant having a neck portion receivable in said slot means and a head portion on the upper end of the neck portion engageable with said upwardly facing pendant support shoulder and supporting the pendant for swivelling movement relative to the pendant support portion of the carrrier means, the pendant retainer clip comprising a thin flat body having upwardly extending flanges along opposite side edges arranged to engage the opposite side edges of the pendant support portion to guide the clip when the clip is moved along a clip installing path generally paralleling the direction of movement of the carrier means along the track into a pendant retaining position in which the body of the clip underlies the underface of the pendant support portion and the flanges of the clip extend along opposite side edges of the pendant support portion to prevent movement of the clip transverse to the clip installing path, the body of the clip having a notch in one end arranged to receive the neck portion of the pendant when the clip is moved into said pendant retaining position, and means for detachably holding said clip in said pendant retaining position.

2. A panel support system according to claim 1 wherein said means for holding the clip in said pendant retaining position includes a constricted portion in the notch in the body of the clip, said constricted portion being spaced from the inner end of the notch in the clip and arranged to snap past the neck portion of the pendant when the clip is moved into said pendant retaining position.

3. A panel support system according to claim 2 wherein said means for holding the clip in said pendant retaining position includes an upwardly facing shoulder on the pendant spaced below the head portion of the pendant and arranged to underlie and support the body of the clip when the clip is in said pendant retaining position.

4. A panel support system according to claim 1 wherein said means for holding the clip in said pendant retaining position includes an upwardly facing shoulder on the pendant spaced below the head portion of the pendant and arranged to underlie and support the body of the clip when the clip is in said pendant retaining position.

5. A panel support system according to claim 4 wherein the clip has an upwardly extending flange on the end opposite said one end arranged to engage one end of the panel support portion of the carrier means.

6. A panel support system comprising an elongated rod having a downwardly opening slot and flanges along opposite sides of the slot defining a track, carrier means mounted on the track for movement therealong and having a lower pendant support portion disposed below the track, a panel support pendant detachably and swivelly mounted on the pendant support portion, and a detachable pendant retainer clip for holding the pendant on the carrier means, the pendant support portion having a generally horizontal underface and spaced side edges generally paralleling the path of movement of the carrier means along the track, the pendant support portion having slot means extending transverse to the direction of movement of the carrier means along the track and opening at one of said side edges intermediate its ends and an upwardly facing pendant support shoulder at the inner end of the slot means, the panel support pendant having a neck portion receivable in said slot means and a head portion engageable with the upwardly facing pendant support shoulder and supporting the pendant for swivelling movement about an upright axis relative to the pendant support portion of the carrier means, the slot means in the pendant support having a constricted portion spaced from its inner end arranged to snap past the neck portion on the pendant when the neck portion of the pendant is inserted into the slot means, the pendant retainer clip comprising a thin flat body having upwardly extending flanges along opposite side edges arranged to engage the opposite side edges of the pendant support portion to guide the clip when the clip is moved along a generally horizontal clip installing path paralleling the direction of movement of the carrier means along the track and with the body and flanges of the clip respectively paralleling the underface and side edges of the pendant support portion into a pendant retaining position underlying the underface of the pendant support portion, wherein the side flanges which extend along opposite side edges of the pendant support portion prevent movement of the clip transverse to the clip installing path, the body of the clip having a notch in one end arranged to receive the neck portion of the pendant when the clip is moved along the clip installing path into said pendant retaining position, and means for holding the clip in said pendant retaining position.

7. A panel support system according to claim 6 wherein said means for holding the clip in said pendant retaining position includes a constricted portion in the notch in the body of the clip, said constricted portion being spaced from the inner end of the notch in the clip and arranged to snap past the neck portion of the pendant when the clip is moved into said pendant retaining position.

8. A panel support system according to claim 7 wherein said means for holding the clip in said pendant retaining position includes an upwardly facing shoulder on the pendant spaced below the head portion of the pendant and arranged to underlie and support the body of the clip when the clip is in said pendant retaining position.

9. A panel support system according to claim 6 wherein said means for holding the clip in said pendant retaining position includes an upwardly facing shoulder on the pendant spaced below the head portion of the pendant and arranged to underlie and support the body of the clip when the clip is in said pendant retaining position.

10. A panel support system according to claim 9 wherein the clip has an upwardly extending flange on the end opposite said one end arranged to engage one end of the panel support portion of the carrier means.

11. A panel support system according to claim 6 wherein said carrier means includes rollers engageable with said flanges on the rod for supporting the carrier means for movement along the rod.

12. A panel support system according to claim 6 wherein said carrier means includes a body having groove means in opposite side edges slidably receiving said flanges on the rod for supporting the carrier means for movement along the rod.

* * * * *

UNITED STATES PATENT AND TRADEMARK OFFICE

CERTIFICATE OF CORRECTION

PATENT NO. : 4,584,737

DATED : April 29, 1986

INVENTOR(S) : Thor Ohman

It is certified that error appears in the above-identified patent and that said Letters Patent are hereby corrected as shown below:

Claim 6, column 6, line 9, insert -- portion -- after "support".

Signed and Sealed this

*Fifteenth* Day of *July 1986*

[SEAL]

*Attest:*

*Attesting Officer*

DONALD J. QUIGG

*Commissioner of Patents and Trademarks*